United States Patent [19]

Hines

[11] Patent Number: 4,864,810

[45] Date of Patent: Sep. 12, 1989

[54] TRACTOR STEAM PISTON BALANCING

[75] Inventor: William R. Hines, Montgomery, Ohio

[73] Assignee: General Electric Company, Cincinnati, Ohio

[21] Appl. No.: 7,878

[22] Filed: Jan. 28, 1987

[51] Int. Cl.[4] ..... F02C 3/04; F01D 3/00

[52] U.S. Cl. ..... 60/39.05; 60/39.161; 60/39.54; 415/105; 415/107; 415/115

[58] Field of Search ..... 60/39.05, 39.54, 39.58, 60/39.53, 39.161; 415/104, 105, 107, 115

[56] References Cited

U.S. PATENT DOCUMENTS

| | | | |
|---|---|---|---|
| 2,647,368 | 8/1953 | Triebbnigg et al. | 60/39.54 |
| 2,647,684 | 8/1953 | Lombard | 415/104 |
| 3,609,057 | 9/1971 | Radtke | 60/39.58 |
| 3,614,255 | 10/1971 | Rooney | 415/107 |
| 4,268,220 | 5/1981 | Malott | 415/104 |
| 4,306,834 | 12/1981 | Lee | 415/116 |
| 4,569,195 | 3/1986 | Johnson | 60/39.3 |
| 4,578,018 | 3/1986 | Pope | 415/14 |
| 4,631,914 | 12/1986 | Hines | 60/39.05 |
| 4,661,043 | 4/1987 | Groenendaal, Jr. et al. | 415/104 |

FOREIGN PATENT DOCUMENTS

| | | | |
|---|---|---|---|
| 3209 | 11/1968 | Japan | 415/107 |

*Primary Examiner*—Donald E. Stout

*Attorney, Agent, or Firm*—Derek P. Lawrence; Harley R. Ball

[57] ABSTRACT

A steam piston balance means for a turbine engine comprises, in one form, a pressure chamber and means for supplying steam to the chamber to apply a force to walls of the chamber. The chamber is defined, in part, by an inner surface portion of a member connected and rotating with a portion of a thrust bearing whereby pressure force applied on the inner surface in turn applies a tractor force on the thrust bearing.

24 Claims, 2 Drawing Sheets

TRACTOR STEAM PISTON BALANCING

This invention relates to turbine engines and, more particularly, to means for relieving axial force on a thrust bearing such as is associated with a rotor.

BACKGROUND OF THE INVENTION

One characteristic of a turbine engine is that it includes rotating components carried by stationary components which absorb or are affected by forces generated by the rotating components. For example, in modern gas turbine engines, a rotating component or rotor comprises a variety of members such as shafts, shaft cones, disks or drums carrying blades, fluid seals, and various connecting structural members. At different points or portions in the engine, depending upon the relative pressure, thrust forces in the engine act axially on the engine. In the turbine portion of the engine in which gas stream or fluid flowpath pressures decrease axially downstream on the engine the net axial force is downstream. A compressor driven by a turbine can, to a certain extent, compensate for such net axial downstream force in the turbine: the highest pressure in the compressor is in its latter stages and tends to exert a net axial forward force. However, in a free wheeling power turbine, axial downstream force is absorbed by a thrust bearing or complex arrangement of bearings. State-of-the-art bearings can be used for ordinary gas turbines, including those with standard power turbines.

The gas turbine art, as it relates to industrial applications, has been advancing in one manner through the use of steam to improve thermal efficiency and increase output. Examples of such advances are U.S. Pat. No. 4,569,195—Johnson issued Feb. 11, 1986 and my U.S. Pat. No. 4,631,914 issued Dec. 30, 1986, the disclosures of both of which are hereby incorporated herein by reference. One result has been a significant increase in rotor thrust loads thereby requiring bearings of a capability presently unavailable.

Previously reported means for compensating for such high net axial thrust has been through the use of relatively high pressure air, bled from the compressor and applied to a portion of the engine. Another means, for example as described in U.S. Pat. No. 4,578,018—Pope, the disclosure of which is hereby incorporated herein by reference, utilizes hydraulic fluid for such purpose. However, use of air which the engine has compressed or hydraulic fluids such as used in the engine for lubricating purposes, can cause losses in engine efficiency.

OBJECTS OF THE INVENTION

It is a principal object of the present invention to provide an improved and efficient means for relieving at least a portion of axial rotor thrust in a turbine engine.

Another object is to provide, for a gas turbine engine, such a means which utilizes steam rather than engine air or hydraulic fluid.

A further object is to provide a gas turbine engine system which provides a source of steam and means to utilize the steam for steam piston balancing.

Still another object is to provide an improved method for relieving at least a portion of axial force on a thrust bearing during turbine engine operation.

These and other objects and advantages will be more fully understood from the following detailed description, the drawings and the embodiments, all of which are intended to be typical of rather than in any way limiting on the scope of the present invention.

SUMMARY OF THE INVENTION

Briefly, the present invention in one form provides a steam piston balance means for a turbine engine which comprises a pressure chamber and means for supplying steam to the pressure chamber. The chamber is defined by an inner surface portion of a member connected and rotating with a rotor, a non-rotating second member spaced apart from the inner surface, and sealing means between the rotating inner surface and the non-rotating second member. Also included is means for introducing steam into the chamber to enable the steam to apply a balancing force to the rotor through the connected inner surface.

In another form, there are included means for introducing steam from the chamber into the engine operating fluid flowpath. In still another form, a system is provided with such a steam piston balance means and a source of steam, along with means to deliver steam to the chamber.

In still another form, a turbine engine having a thrust bearing is operated according to a method which directs pressurized steam against a member, for example, a part of a chamber, which relieves at least a portion of axial force on the thrust bearing.

DESCRIPTION OF THE PREFERRED EMBODIMENTS

Figure 1:
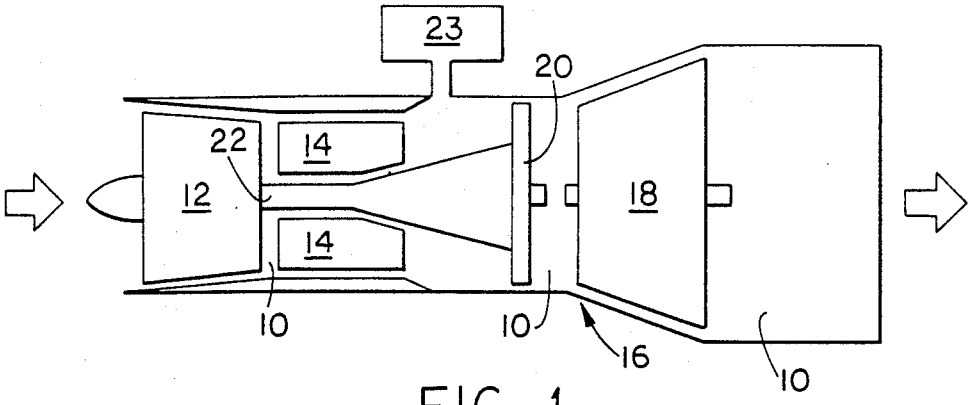
FIG. 1 is a diagrammatic view of one relatively simple form of a gas turbine engine, having a power turbine, and which can be utilized with the present invention.

The present invention is particularly useful with industrial gas turbine engines derived from aircraft gas turbines, when adapted to operate as steam injected versions. Generally, these types of engines have single or dual rotor core engines with free wheeling power turbines. This arrangement differs from the standard, heavier industrial gas turbine engines for electrical power generation in that the standard engines generally are single shaft configurations running at a fixed speed, for example 3,000 or 3,600 revolutions per minute. The axially downstream or aft powered turbine rotor thrusts of such engines are balanced to a large degree by axially forward or upstream compressor rotor forces.

With the advent of high pressure ratio steam injected engines of the type described in the above incorporated Johnson patent and Hines patent, engine specific horsepower can be increased many times, for example, by a factor of 5, when compared with their "dry" versions in which steam is not injected. Power turbine rotor thrust levels have increased up to about 285,000 pounds aft force, resulting in a 3–5 times increase in rotor thrust loads. These loads are beyond the capability of state-of-the-art bearings for the shaft sizes involved. In addition, current very large size bearings require very large amounts of oil for operation and are subject to large friction losses. Attempting to distribute the load in a duplex or other complex bearing arrangement presents many problems as to how to accomplish, and the efficiency and reliability of, such distribution. The present invention presents a more simple, effective, reliable alternative.

The innovative solution of the present invention to such problem takes advantage of a source of high pressure steam, generally and conveniently available from an exhaust heat boiler used to create steam under pressure for injection into the engine. For example, one such arrangement is described in the above incorporated Johnson patent. In one form of the present invention, the steam is used to place a pressure or piston type force forward in respect to the power turbine. Such force is exerted on a surface of a member connected and rotating with the power turbine rotor. Because such members are connected with at least a portion of the thrust bearing, a tractor or pulling force is applied forwardly to the thrust bearing. This relieves at least a portion of the aft or downstream bearing force resulting from operation of the power turbine.

Using the present invention, an advanced, steam injection, high pressure ratio engine can be designed with a single bearing which can easily handle the rotor thrust load while running dry—without steam injection. At the same time, such bearing can take up adequate rotor thrust load, for example half, when running with steam injection, in cooperation with the tractor steam piston balance means of the present invention, to enable safe, efficient operation. Such single bearing need only be designed to handle the incremental rotor thrust load for dry operation, with the tractor steam piston balance means of this invention being designed to handle the remainder of the possible rotor thrust load during steam injection operation.

The present invention will be more fully understood from the drawings and the following more detailed examples which are intended to be typical of, rather than in any way limiting on, the scope of the present invention. FIG. 1 illustrates, diagrammatically, a relatively simple steam injection-type engine. This and more complex forms of this type of engine are described in the above incorporated Johnson U.S. Pat. No. 4,569,195. Such engine comprises, in series along an operating fluid flowpath 10, compressor means or compressor 12, combustion means 14, and turbine means shown generally at 16 and including a free rotating power turbine 18 used to generate electrical or mechanical power, as is well known in the art. Compressor 12 is connected to turbine 20, which drives compressor 12 by a shaft 22. However, power turbine 18, generally supported from stationary engine structure by power turbine forward and aft bearings, is free to rotate as a function of gases expanding through its turbine blades. A more detailed view of one type of power turbine is shown in the fragmentary sectional view of FIG. 2. Pressurized steam from source 23, generally at a superheat condition, can be introduced into the engine aft of turbine 20 as shown in FIG. 1.

Figure 2:
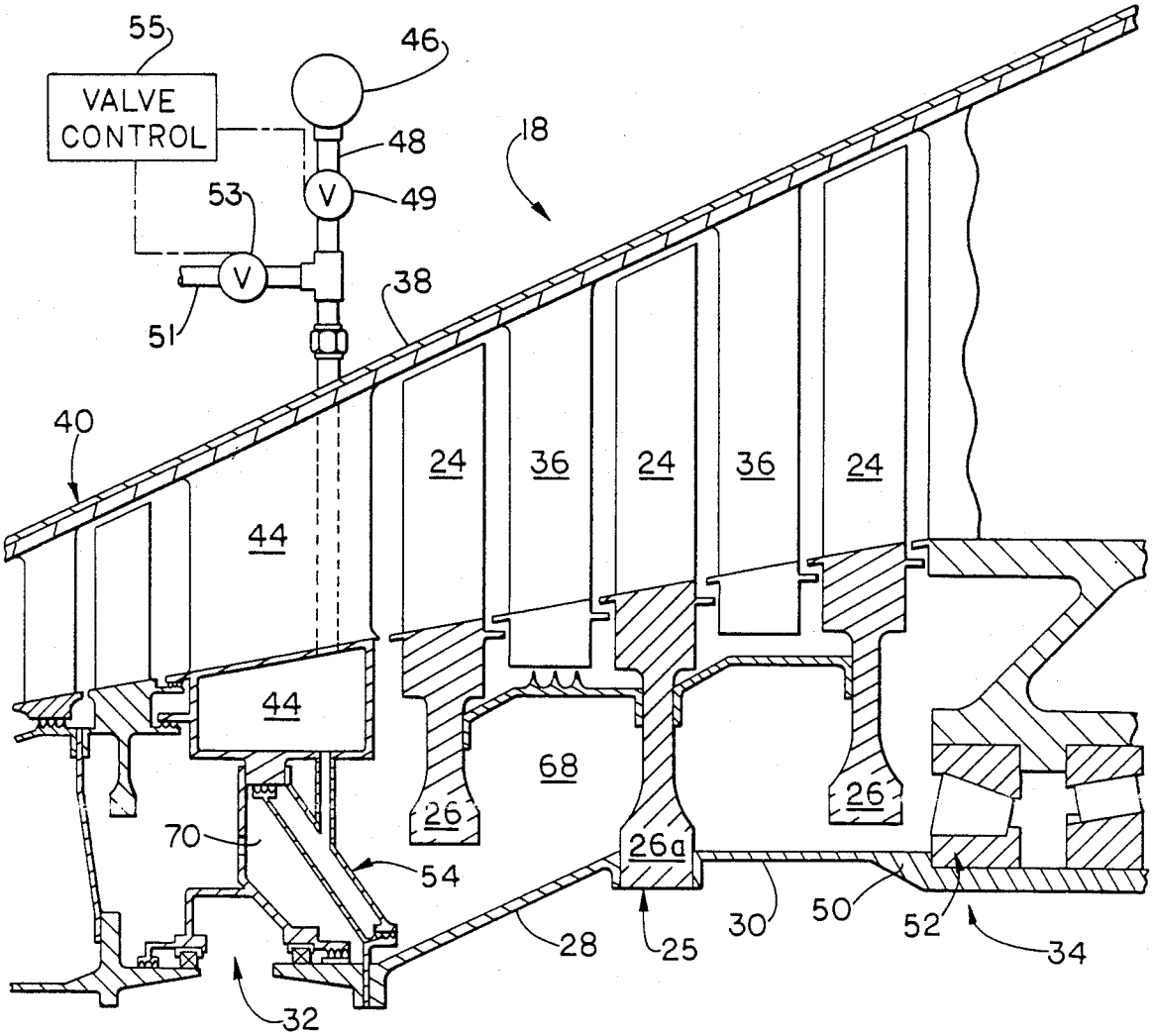
FIG. 2 is a fragmentary sectional view primarily of the power turbine section of a gas turbine engine embodying the present invention.

With reference to FIG. 2, power turbine shown generally at 18 includes a turbine rotor 25 comprised of a plurality of turbine blades 24 carried by interconnected, rotating wheels or disks 26. At least one of the disks, for example 26a in FIG. 2, is connected through rotating structural members 28 and 30 to forward and aft bearing and seal arrangements shown generally at 32 and 34, as is generally well known in the art. Stationary vanes 36, carried by a stationary outer structure, such as outer casing 38, are disposed between rotating blades 24. In the engine of FIG. 2, a low pressure turbine 40 is shown upstream (to the left of the figure) of the power turbine 18, with the division between the low pressure turbine 40 and power turbine 18 occurring in the vicinity of stationary hollow strut 44.

Rotating structural member 30 connected in the aft portion of the power turbine to rotating disk 26a, is joined with an additional structural member 50 associated with the rotating portions of bearing means 34. In FIG. 2, a thrust bearing is shown generally at 52 in bearing means 34. Through this general type of arrangement known in the art, the aft net axial thrust from the power turbine is handled by the thrust bearing.

Figure 3:
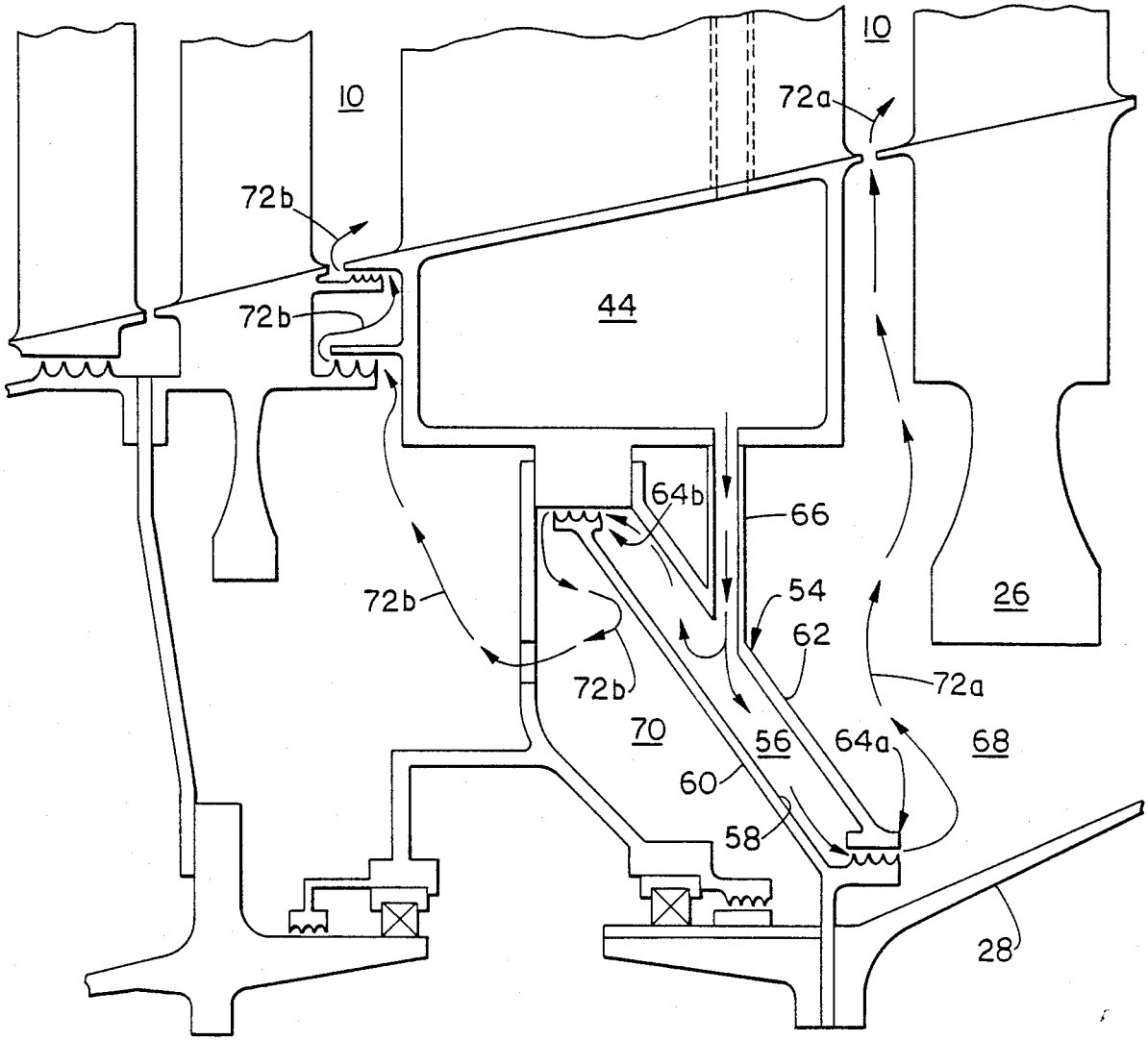
FIG. 3 is an enlarged view of a portion of FIG. 2 detailing a form of the present invention.

A steam manifold 46, connected to a source of pressurized steam 23, such as is shown in FIG. 1, introduces steam through conduit means 48 and the interior of strut 44 to one form of the tractor steam piston balance means of the present invention shown generally at 54 and in more detail in FIG. 3. In the embodiment of FIG. 2, conduit 48 includes a steam flow control valve 49 discussed in detail later. In addition, steam conduit 48 is joined with an air conduit 51 including an air control valve 53, discussed in more detail later.

In the fragmentary sectional view of FIG. 3, the tractor steam piston balance means of the present invention comprises a pressure chamber 56 having a rotating inner surface 58 of a portion of first member 60 connected to and rotating with the power turbine rotor 25, such as shown in FIG. 2, through rotating structural member 28. Pressure chamber 56 is defined further by a non-rotating or stationary second member 62, carried by stationary strut 44 and spaced apart from surface 58 of first member 60. In the embodiment of FIG. 3, first and second members 60 and 62 are substantially annular, spaced apart members with rotating first member 60 and rotating inner surface 58 generally axially forward of stationary second member 62, as shown in FIG. 3. Completing the definition of the pressure chamber 56 in FIG. 3 are sealing means **64*a* and 64*b*** presented in the Figure as, respectfully, radially inner and outer fluid pressure drop seals in the form of labyrinth type seals well known and widely used in the art. Conveniently, such seals are annular in shape.

Pressurized steam, for example under a pressure at least greater than that at the power turbine fluid entrance station just upstream of strut 44 and as high in pressure as required for thrust balance, from the steam source 23 of FIG. 1, is supplied from manifold 46 and conduit means 48 of FIG. 2 through the hollow interior of strut 44 to a steam conduit 66 of FIG. 3 and then to pressure chamber 56. The steam acts on walls of the chamber to apply a force consistent with the manner in which a pressurized fluid acts within such a chamber. However, because rotating member 60 of chamber 56 is connected through rotor 25 to thrust bearing 52, as previously described, force applied to inner surface 58 of first member 60 will be transmitted as an axial, forwardly directed tractor or pulling force to thrust bearing 52 thereby relieving at least a portion of the axial aft force on such bearing resulting from engine operation. Therefore, steam applying a pressure force on the inner surface 58 of member 60 in turn applies a tractor force on the thrust bearing.

Another feature of the form of the present invention detailed in FIG. 3 is means for passing steam from pressure chamber 56 into the gas turbine engine fluid flowpath 10 for efficiency enhancement, for example as described in the above incorporated Johnson patent.

Steam from within chamber 56 flows in a controlled manner, for example through sealing means 64*a* and 64*b*, for passage into the engine fluid flow or gas stream path 10 in the turbine section of the engine. Such passage of steam can occur from the radially inner and outer sealing means into engine chambers 68 and 70, respectfully, and then through various engine structures and components as shown by arrows 72*a* and 72*b*.

Another feature of the form of the present invention shown in FIG. 2 is the provision of a steam flow control means such as valve 49 in steam conduit 48, or elsewhere in the steam inlet line to chamber 56 if more convenient, to adjust or control the flow of pressurized steam into pressure chamber 56. In one example, such a valve can be operated, at least in part, as a function of the wear of sealing means 64*a* and 64*b* during operation. Such seal wear would tend to allow more steam to flow from chamber 56 thereby reducing the pressure in the chamber and in turn reducing the tractor force or action on the thrust bearing such as 52 in FIG. 2. Operation of such a flow control means as valve 49 can be directed by a more central control to which signals of force or stress levels, or other conditions, on bearing 52 can be transmitted. This can be accomplished utilizing signal sensing and transmitting technology and means well known and used in the gas turbine part for sensing and transmitting engine operating conditions and parameters within the engine and its associated systems.

Still another feature of the form of the present invention as shown in FIG. 2 is the provision of an air conduit 51 controlled by air control means or valve 53. Such a structure is provided to accommodate the condition under which the engine is operated in the "dry" condition; i.e., without the injection of steam for enhanced power and efficiency as described in the above incorporated Johnson Patent. In such "dry" type operation, thrust bearing 52 can accommodate the axially directed thrust force as in an ordinary gas turbine engine. However, it may be desirable to provide a purging type air flow or pressurized air into chamber 56 and then to chambers 68 and 70. For example, when valve 49 in conduit 48 is closed and no steam is flowing through conduit 48, valve 53 can be opened to the extent desired to pass pressurized air, conveniently bled upstream in the engine such as from the compressor, through conduit 51 and into the chambers 56, 68 and 70.

Coordination and the extent of the operation of valves 49 and 53 can be accomplished through relatively simple fluid flow control means such as switching or valve control means 55 in FIG. 2. For example, switching can be included in an engine control which selects operation between "dry" and steam injection, using technology well known in the gas turbine engine control art. Further, this steam to air partial or full switching can be programmed in the fluid flow control means 55 in various ways. For example it can be varied as a function of power turbine rotor thrust bearing oil pump pressure; i.e., the steam to the steam piston can be reduced when the power turbine thrust bearing load is below design levels. In another form, the ratio of steam cavity pressure to power turbine inlet gas flow pressure can be set by steam valve throttling to control tractor rotor thrust needs.

Comparison calculations have been made between the present invention and the expected performance of more complex mechanical bearings, such as matched pairs of load sharing bearings, which would have to be designed for the above described high load conditions during steam injection operation. Comparison calculations have shown that the present invention has about the same thermal efficiency without the risks and power losses associated with such type of complex mechanical bearing devices. Also comparison calculations have shown that the present invention has about the same thermal efficiency impact associated with such type of complex mechanical tapered rolling bearing load sharing devices, having about a 1% horsepower loss but without the risks. It is a more reliable system with more dependable life predictions; it eliminates the handling of a large oil supply and pumps associated with other systems.

Use of flow control means 55 and its coordination of the flow of pressurized steam, such as from source 23 in FIG. 1, through conduit 48, and the flow of pressurized air through conduit 51 generally is as a function of engine operation. One example is the event that engine power is decreased, as by throttle pull back, from steam injection toward "dry" or no steam operation. Control means 55 can direct air valve 53 and steam valve 49 to operate to throttle the respective pressures individually such that steam pressure is reduced at constant total enthalpy, and the steam superheat will increase. In this way, mixing of the pressurized, superheated steam and cooler air will not cause condensation. Another example is the event that engine power is increased, as by throttle advance, from "dry" operation, with purge air, toward steam injection operation. The source or supply of pressurized air can be selected to be at a temperature sufficiently high to inhibit condensation as superheated steam is added. Such control and coordination can be accomplished using the type of cycle design and sensing, conduit and switching technology known and used in the turbine engine art.

Although the present invention has been described in connection with specific examples and embodiments, it will be recognized by those skilled in the various arts involved that other embodiments and modifications can be made without departing from the scope of the invention as represented by appended claims.

What is claimed is:

1. In a turbine engine having a turbine comprised of a plurality of stages, a thrust bearing, a tractor steam piston balance means connected with the thrust bearing for relieving at least a portion of an axially rearward force from the thrust bearing, comprising:

a pressure chamber having a rotating inner surface defined by at least a portion of a first member which is connected and rotating with a rotating portion of the thrust bearing;

means for supplying pressurized steam to said pressure chamber and against said inner surface to apply an axially forward pressure force on said inner surface and, in turn, an axially forward, tractor force on said thrust bearing; and means for passing steam from said pressure chamber into the turbine operating fluid flowpath.

2. The turbine engine of claim 1, wherein said means for passing steam further comprises means for passing at least a portion of the steam into the first stage of said turbine.

3. In a turbine engine having a turbine comprised of a plurality of stages, an operating fluid flowpath and including a rotor supported axially by at least one rotor thrust bearing, a tractor steam piston balance means connected with the thrust bearing for relieving at least a portion of an axially rearward force from the thrust bearing, comprising:

a pressure chamber having a rotating inner surface defined by at least a portion of a first member which is connected and rotating with the rotor, a non-rotating second member spaced apart from said inner surface, and sealing means between said rotating inner surface and said non-rotating second member said rotating inner surface being disposed generally axially forward of said non-rotating second member;

means for supplying pressurized steam to said pressure chamber and against said inner surface to apply an axially forward pressure force on said inner surface and, in turn, an axially forward, tractor force on said thrust bearing; and means for supplying steam from said pressure chamber into the operating fluid flowpath.

4. The engine of claim 3 in which steam from said pressure chamber is passed through said sealing means.

5. The tractor steam piston balance means of claim 3 in which said sealing means comprises a pair of labyrinth pressure drop seals.

6. The tractor steam piston balance means of claim 3 in which:

said first member and said second member are substantially annular, spaced apart members carried, respectively, by rotating structure and non-rotating structure, defining, with said sealing means, a substantially annular pressure chamber; and said sealing means comprise radially inner and outer fluid pressure drop seals adapted to control flow of steam from said pressure chamber.

7. The turbine engine of claim 3 in which the means for supplying pressurized steam to said pressure chamber includes steam flow control means to control the flow of steam into said pressure chamber at least as a function of engine operation.

8. The turbine engine of claim 7 which includes:

means for supplying pressurized air to said pressure chamber;

air flow control means to control flow of said pressurized air into said pressure of chamber; and fluid flow control means operatively connected with said steam flow control means and said air flow control means to coordinate flow of steam and air into said pressure chamber as a function of engine operation.

9. The turbine engine of claim 3, wherein said means for supplying steam further comprises means for passing at least a portion of the steam into the first stage of said turbine.

10. In an axial flow gas turbine engine comprising, in series along an operating fluid flowpath, compressor means, combustion means, and turbine means having a plurality of turbine stages and including a power turbine having a freely rotating power turbine rotor supported axially by at least one rotor thrust bearing, a tractor steam piston balance means connected with the thrust bearing for relieving at least a portion of axially rearward force from the thrust bearing comprising:

a pressure chamber radially inward of the power turbine operating flowpath, and having a rotating inner surface defined by at least a portion of a first member which is connected and rotating with the rotor, a non-rotating second member spaced apart from said inner surface, and sealing means between said rotating inner surface and said non-rotating second member said rotating inner surface being disposed generally axially forward of said non-rotating second member; and means for supplying pressurized steam to said pressure chamber and against said inner surface to apply an axially forward pressure force on said inner surface and, in turn, an axially forward, tractor force on said thrust bearing.

11. The gas turbine engine of claim 10 which includes means for passing steam from said pressure chamber into the turbine means operating fluid flowpath.

12. The turbine engine of claim 11, wherein said means for passing steam further comprises means for passing at least a portion of the steam into the first stage of said turbine.

13. The tractor steam piston balance means of claim 10 in which:

said first member and said second member are substantially annular, spaced apart members carried, respectively, by turbine rotating structure and turbine non-rotating structure, defining, with said sealing means, a substantially annular pressure chamber; and said sealing means comprise radially inner and outer fluid pressure drop seals adapted to control flow of steam from said pressure chamber.

14. The gas turbine engine of claim 10 which includes;

means for supplying pressurized air from said compressor means to said pressure chamber;

air flow control means to control flow of said pressurized air into said pressure chamber; and fluid flow control means operatively connected with said steam flow control means and said air flow control means to coordinate flow of steam and air into said pressure chamber as a function of engine operation.

15. The turbine engine of claim 14, wherein said means for introducing steam further comprises means for passing at least a portion of the steam into the first stage of said turbine.

16. A gas turbine engine system comprising a source of steam at a first pressure; an axially flow gas turbine engine having, in series along an operating fluid flowpath, compressor means, combustion means, and turbine means having a plurality of turbine stages, the engine including a rotor supported axially by at least one rotor thrust bearing; and means to introduce steam into the engine, wherein:

the engine includes a tractor steam piston balance means connected with the thrust bearing for relieving at least a portion of axially rearward force from the thrust bearing, the steam piston balance means comprising:

(a) a pressure chamber having a rotating inner surface defined by at least a portion of a first member which is connected and rotating with the rotor, a non-rotating second member spaced apart from said inner surface, and sealing means between said rotating inner surface and said non-rotating second member said rotating inner surface being disposed generally axially forward of said non-rotating second member;

(b) means for supply the steam to said pressure chamber and against said inner surface to apply an axially forward pressure force on said inner surface and, in turn, an axially forward, tractor force on said thrust bearing; and (c) means for introducing steam from said pressure chamber into a selected portion of the operating fluid flowpath downstream of the compressor means, the fluid in the flowpath at the selected portion being at a second pressure less than the first pressure.

17. In a method for operating an axial flow gas turbine engine having a turbine comprised of a plurality of stages, an axially rearward directed operating fluid flowpath and a thrust bearing which is subjected during operation to an axially rearward force, the steps of:

providing a supply of pressurized steam;

directing the steam against a member connected with the thrust bearing to apply a pressure force to the member in an axially forward direction to relieve at least a portion of the axially rearward force; and flowing steam from said pressure chamber into said operating fluid flowpath.

18. The method of claim 17 which includes the step of directing the steam, after being applied against the member, into the operating fluid flowpath.

19. The method of claim 17 in which the member defines at least a portion of a pressure chamber, including the steps of:

directing the steam into the pressure chamber and against the member;

providing a supply of pressurized air and means to direct said air into the pressure chamber; and controlling and coordinating the flow of the pressurized air and pressurized steam into the pressure chamber as a function of engine operation.

20. The method of claim 19 in which the flow of the air and the flow of the steam are controlled and coordinated as engine power is decreased to reduce steam pressure at constant total enthalpy and to increase steam superheat.

21. The method of claim 19 in which the flow of the air and air temperature, and the flow of the steam are controlled and coordinated as engine power is increased to inhibit condensation from the steam.

22. The method of claim 17 wherein the steam directed against the member, which defines at least a portion of a pressure chamber, to relieve axially rearward force on the thrust bearing, is varied in amount as a direct function of the amount of steam flowing from the pressure chamber.

23. The method of claim 19 for transitioning engine operation between steam injection and without steam injection wherein:

the steam is directed into the pressure chamber and against the member for engine operation with steam injection; and the flow of the pressurized air and pressurized steam is as a function of transition of engine operation between steam injection and without steam injection.

24. The turbine engine of claim 16, further comprising the step of flowing at least a portion of the steam into the first stage of said turbine.

* * * * *